US010378756B2

(12) United States Patent
Collins, III et al.

(10) Patent No.: US 10,378,756 B2
(45) Date of Patent: Aug. 13, 2019

(54) TWO-PIECE CERAMIC FERRULE ASSEMBLY

(71) Applicant: BLASCH PRECISION CERAMICS, INC., Albany, NY (US)

(72) Inventors: Edwin L. Collins, III, Albany, NY (US); William P. Russell, Waterliet, NY (US); Jeffrey J. Bolebruch, Amsterdam, NY (US)

(73) Assignee: Blasch Precision Ceramics, Inc., Albany, NY (US)

( * ) Notice: Subject to any disclaimer, the term of this patent is extended or adjusted under 35 U.S.C. 154(b) by 41 days.

(21) Appl. No.: 15/127,628

(22) PCT Filed: May 11, 2015

(86) PCT No.: PCT/US2015/030120
§ 371 (c)(1),
(2) Date: Sep. 20, 2016

(87) PCT Pub. No.: WO2015/175395
PCT Pub. Date: Nov. 19, 2015

(65) Prior Publication Data

US 2017/0146231 A1 May 25, 2017

Related U.S. Application Data

(60) Provisional application No. 61/993,326, filed on May 15, 2014.

(51) Int. Cl.
*F22B 37/08* (2006.01)
*F22B 1/18* (2006.01)

(52) U.S. Cl.
CPC ..... *F22B 37/08* (2013.01); *F22B 1/1838* (2013.01)

(58) Field of Classification Search
CPC ..... F22B 37/08; F16G 11/025; F16G 11/08; F16L 47/24; F16L 47/28
USPC ..... 16/108, 109
See application file for complete search history.

(56) References Cited

U.S. PATENT DOCUMENTS 426,515 A * 4/1890 Rice ..... F16L 47/24 285/148.13
989,251 A * 4/1911 Hall ..... F16L 37/252 277/613
3,318,374 A * 5/1967 Block ..... F22B 1/1876 165/134.1

(Continued)

OTHER PUBLICATIONS

International Search Report and Written Opinion, International Application No. PCT/US2015/030120, dated Jul. 29, 2015 (9 pages).

*Primary Examiner* — Jeffrey O'Brien
(74) *Attorney, Agent, or Firm* — Burr & Brown, PLLC

(57) ABSTRACT

A ceramic ferrule assembly is provided, including a head including at least one tab protruding outwardly from an inner peripheral surface thereof, and a stem having an annular flange about an outer peripheral surface thereof and having at least one slot formed therein, the slot being adapted to receive the tab and retain the tab in a stationary position when the stem is rotated relative the head, whereby the at least one tab and the at least one slot mechanically engage one another to secure the ferrule stem and ferrule head to prevent axial disassociation from one another without counter rotation.

14 Claims, 6 Drawing Sheets

100

(56) References Cited

U.S. PATENT DOCUMENTS

| | | | | | |
|---|---|---|---|---|---|
| 3,747,964 | A * | 7/1973 | Nilsen, Jr. | F16L 37/113 | 285/337 |
| 4,176,612 | A * | 12/1979 | Speer | F23J 13/00 | 110/323 |
| 4,433,644 | A * | 2/1984 | Fitzpatrick | F22B 1/1884 | 110/323 |
| 5,647,432 | A * | 7/1997 | Rexford | F22B 37/08 | 165/134.1 |
| 5,775,269 | A * | 7/1998 | Lawrence | F22B 37/08 | 122/511 |
| 5,954,121 | A * | 9/1999 | Rexford | F22B 37/08 | 165/134.1 |
| 6,173,682 | B1 * | 1/2001 | Parnell | F22B 37/08 | 122/511 |
| 2011/0024094 | A1 * | 2/2011 | Collins, III | F28F 19/002 | 165/134.1 |

* cited by examiner

100

100

TWO-PIECE CERAMIC FERRULE ASSEMBLY

FIELD OF THE INVENTION

The present invention relates to ceramic ferrules for use in connection with tube sheets of waste heat boilers in general, and specifically, to a two-piece ceramic ferrule assembly including a ferrule head and a ferrule stem that are mechanically mated to one another prevent axial and radial disassociation during use.

BACKGROUND OF THE INVENTION

Waste heat boilers are commonly used for the recovery of thermal energy from process gas in industrial applications. Waste heat boilers typically include an array of metallic tubes that are secured on each end by comparatively thick plates that are referred to in the art as tubesheets. The tubesheets are surrounded by a shell to form a pressure vessel. Hot process gas is introduced to the waste heat boiler at one end, and flows down the inside diameters of the tubes. Boiler feed water is fed to the other side of the tubes within the pressure vessel. Heat is transferred by conduction through the tube walls from the hot process gas to the boiler feed water, thereby producing pressurized steam for use in other processes.

Since the tubesheet has a greater thickness than that of the boiler tube wall, heat transfer is retarded in this region, and tubesheet temperatures at the inlet end can reach levels where certain modes of corrosion are problematic. Accordingly, it is often necessary to protect the front plate of the waste heat boiler and the inlet ends of the tubes from such high temperatures and/or highly corrosive atmospheres. This is commonly achieved using a combination of ceramic ferrules and castable refractory pieces.

One common ceramic ferrule design is a two-piece design including a ferrule head piece, which protects the front face of the waste heat boiler, and a ferrule stem piece, which protects the tube inlet. During assembly, the ferrule stem is inserted into and passes through the ferrule head, and a sealing gasket of refractory ceramic fiber sleeve fills the space between the head and stem to secure the connection through compression of the fiber. One of these ferrule assemblies is inserted into each tube in the waste heat boiler and secured in place by additional fiber provided around the ferrule stem outside diameter and between the boiler tube inside diameter.

FIG. 1 is a perspective view of such a conventionally known two-piece ceramic ferrule, and FIG. 2 is a cross-sectional view of the two-piece ceramic ferrule shown in FIG. 1. As shown, the two-piece ferrule 10 includes a ferrule stem 2 that is inserted into the ferrule head 1. The ferrule stem 2 is held in place by the compressive forces attributed to the location of the ceramic fiber braided rope 4 and the ceramic fiber gasket 5, along with the heat resistant fiber sleeve 3B, which is provided on a portion of the outer diameter (OD) of the stem 2 that is located within the central bore of the head 1 (see FIG. 2). The ferrule stem 2 also includes a flange 21 at one end thereof, which is seated against an annular rim 122 within the central bore of the head 1 to prevent the stem 2 from passing completely through the head 1. A heat resistant fiber sleeve 3C is provided on a portion of the outer diameter of the ferrule stem 2 that remains extended from the ferrule head 1, and the heat resistant fiber sleeve 3A is provided on a portion of the outer surface of the head 1.

As described above, a piece of compressed high temperature ceramic fiber is used to secure the connection between the ferrule head land the ferrule stem of the two-piece ferrule 10. However, when the ferrules 10 are used in service, the forces present can cause separation between the respective heads 1 and the stems 2, resulting in the failure of that ferrule 10 from its intended use. At the minimum, this requires refractory repair and replacement of the ferrules 10 causing production down time, which is costly not only in terms of manpower and parts, but in terms of process down-time and lost productivity. More likely, however, is the potential for catastrophic failure of the boiler and tube due to the thermal degradation and corrosion that results from the ferrules not being properly in place. This scenario is significantly more costly than mere refractory replacement.

One mode of failure of the above-described two-piece design occurs when the stem 2 disassociates from or "backs out" of the head 1, which can be caused by vibrations in the system or any kind of resultant back pressure, which is common during cleaning operations. Once the stem 2 is unseated from its properly assembled position, it is possible for the process gas to bypass the ferrule 10 by transitioning along the stem 2 outer diameter (OD), contacting the waste heat boiler tubesheet area and causing unacceptable heating and subsequent corrosion.

SUMMARY OF THE INVENTION

The object of the present invention is to provide a two-piece ceramic ferrule that is not susceptible to the above-described drawbacks associated with the prior art two-piece ferrule design. In view of the above, the present invention aims to provide a two-piece ferrule assembly including mechanical features on the ferrule head that work in conjunction with corresponding mechanical features on the ferrule stem to secure the two pieces of the ferrule assembly together in order to prevent the ferrule stem and head from disassociating during service due to vibrations or other external forces.

According to one embodiment of the present invention, a ceramic ferrule assembly is provided, comprising a ferrule head and a ferrule stem. The ferrule head comprises at least one tab protruding outwardly from an inner peripheral surface thereof, and the ferrule stem comprises an annular flange about an outer peripheral surface thereof and has at least one slot formed therein. The slot is adapted to receive the tab and retain the tab in a stationary position when the ferrule stem is rotated relative the ferrule head, whereby the at least one tab and the at least one slot mechanically engage one another to secure the ferrule stem and the ferrule head to one another and to prevent axial and radial disassociation from one another without otherwise providing specific counter rotation.

According to another aspect of the present invention, a ceramic ferrule assembly is provided, comprising a ferrule head having a hexagonal outer peripheral shape and extending from a first end to an opposed second end and defining a length thereof. The ferrule head has a central bore extending from a hexagonal opening at the first end of the ferrule head to a circular opening at the second end of the ferrule head along the length thereof defining a longitudinal extension axis (central axis) thereof. The central bore has an inner peripheral surface defined by a first section having a tapered hexagonal shape extending from the first hexagonal opening to an annular ridge, and a second section having a cylindrical shape extending from the annular ridge to the circular opening at the second end. At least one tab is provided, extending from a portion of the inner peripheral surface of the ferrule head. The ceramic ferrule assembly also includes a ferrule stem extending from a first end toward an opposed second end and defining a length thereof along a longitudinal extension axis (central axis) of the ferrule stem. A first radial flange is spaced a distance away from the second end of the stem along the longitudinal extension direction of the ferrule stem and has a slot formed therein. A second radial flange is located proximate and defining the second end of the ferrule stem. The at least one tab of the ferrule head resides in the slot in a rotatably engaged position, securing the ferrule stem to the ferrule head without adhesive or additional sealing means, and the second flange of the ferrule stem is seated on the annular ridge of the inner peripheral surface of the ferrule head.

Preferably, the outer diameter of the second flange of the ferrule stem is greater than an outer diameter of the first flange of the ferrule stem, and the outer diameter of the first flange is greater than an outer diameter of the ferrule stem.

According to one aspect, the opening of the at least one slot is parallel with respect to the longitudinal extension axis of the ferrule stem. According to another aspect, the opening of the at least one slot is helically-shaped. When the opening/slot is helically-shaped, it is preferred that the slot has an angle of 45° or less with respect to the longitudinal extension axis of the ferrule stem.

According to another aspect of the present invention, the at least one tab comprises two tabs diametrically opposed to one another on the inner peripheral surface of the ferrule head. In accordance with this embodiment, it is preferred that the at least one slot likewise comprises at least two slots diametrically opposed to one another on the first annular flange. According to one aspect of this embodiment, the openings of the two slots are parallel with respect to the longitudinal extension axis of the ferrule stem. According to another aspect of this embodiment, the two slots are helically-shaped.

The ceramic ferrule head and ferrule stem are preferably formed from ceramic materials including, but not limited to alumina, mullite and silicon carbide, for example. The slot and tab features can be integrally formed with the respective ferrule stem and ferrule head pieces when the respective pieces are initially formed by casting, molding or other suitable ceramic forming processes, such as extruding and machining. Alternatively, the slots and tabs can both be subsequently formed by known ceramic machining processes.

BRIEF DESCRIPTION OF THE DRAWINGS

For a better understanding of the nature and object of the present invention, reference should be made to the following detailed description of a preferred mode of practicing the invention, read in connection with the accompanying drawings, in which:

FIGS. 3A-3D are perspective views of ceramic ferrule stems 200 and 210 according to the present invention, wherein FIGS. 3A and 3B are perspective views of a ceramic ferrule stem 200 having an annular flange 211 with an L-shaped slot 220 having an opening 221 that extends parallel to the longitudinal extension axis of the ferrule stem according to one aspect of the present invention, and FIGS. 3C and 3D are perspective views of a ceramic ferrule stem 210 having an annular flange 211' with a slot 230 having a helically-shaped opening according to another aspect of the present invention;

DETAILED DESCRIPTION OF THE INVENTION

Figure 1:
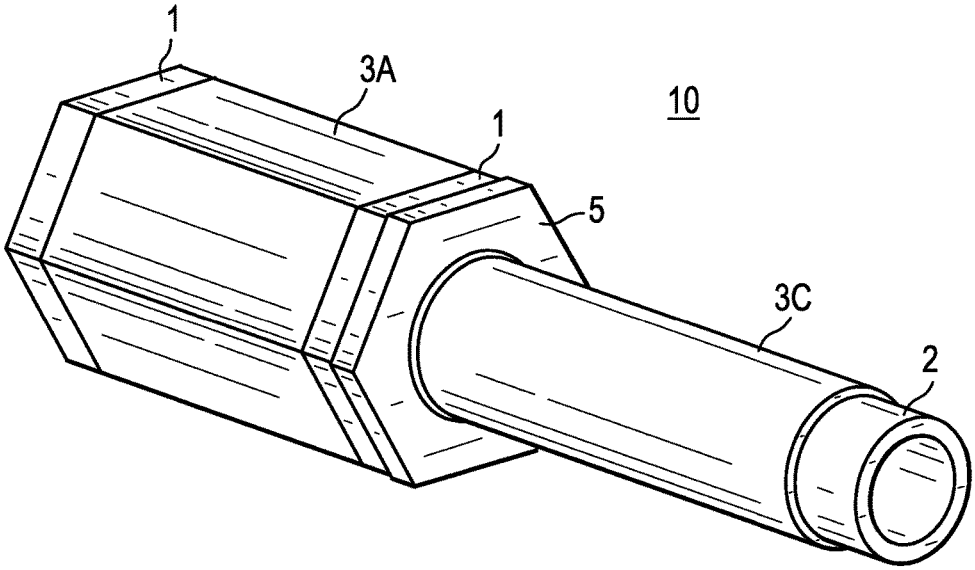
FIG. 1 PRIOR ART
FIG. 1 is a perspective view of a prior art two-piece ceramic ferrule.
Figure 2:
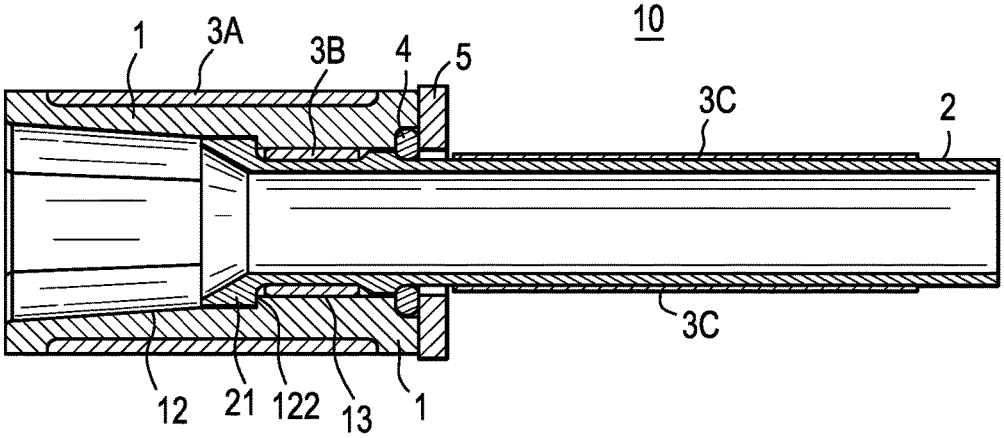
FIG. 2 PRIOR ART
FIG. 2 is a cross-sectional (cut) view of the prior art two-piece ceramic ferrule shown in FIG. 1.
Figure 3A:
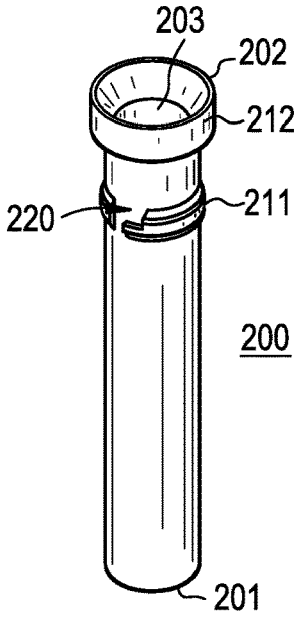
Figure 3B:
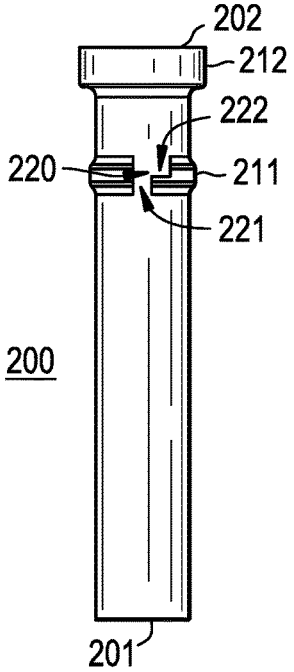

FIGS. 3A and 3B are perspective views of a ceramic ferrule stem 200 according to one aspect of the present invention. The ferrule stem 200 extends from a first end 201 to an opposed second end 202 along the length thereof, defining the longitudinal extension axis (central axis) of the ferrule stem 200. A substantially cylindrical central bore 203, having a substantially cylindrical inner diameter (ID), extends along the length of the ferrule stem 200 from a circular opening at the first end 201 to a circular opening at the second end 202. A first annular flange 211 is provided, circumscribing the outer diameter (OD) of the ferrule stem 200 and spaced a distance away from the second end 202, and a second annular flange 212 is provided, circumscribing the OD of the ferrule stem 200 proximate and defining the second end 202 of the ferrule stem 200.

The outer diameter of the second flange 212 is greater than the outer diameter of the first flange 211, and the outer diameter of the first flange 211 is greater than the OD of the ferrule stem 200. Preferably, the outer diameter of the first flange 211 is 1.3 inches, the outer diameter of the second flange 212 is 1.5 inches and the OD of the ferrule stem 200 is 1.1 inches. It is also preferred that the first flange 211 is spaced a distance of 1.0 inch, more preferably 0.250 inches, from the second end 202 of the ferrule stem 200 in the longitudinal extension direction.

The annular flange 211 has a slot 220 formed therein with an opening portion that extends parallel to the longitudinal extension axis of the stem 200, and has a general L-shape according to one aspect of the present invention. That is, as shown in FIG. 3B, the slot 220 has a slot first part 221 that extends parallel to the longitudinal extension axis (central axis) of the ferrule stem 200, and a slot second part 222 that is substantially perpendicular with respect to the first part 221, and represents a circumferential extension portion of the slot 220 in which a tab T on the ferrule head 100 (see, e.g., FIGS. 4A and 4B) is positionally located once the ferrule stem 200 is rotatably positioned with respect to the ferule head 100 to define the ferrule assembly 500, as described below (see, e.g., FIG. 6A). In connection with the above, the dimensions (i.e., length and width of the slot first and second parts 221 and 222 must at least matingly correspond to the dimensions of the tab T, so that the T is able to pass through the slot first part 221 and then reside within the slot second part 222 without becoming dislodged during operative use.

Figure 3C:
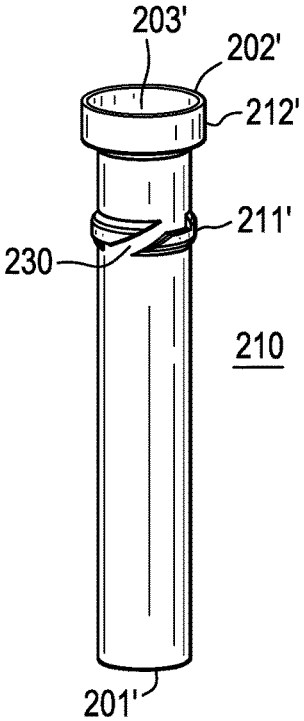
Figure 3D:
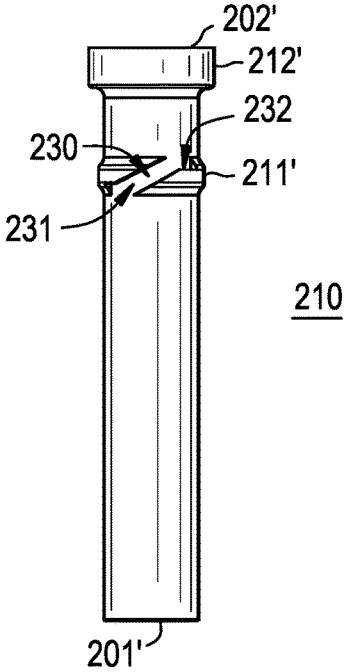

FIGS. 3C and 3D are perspective views of a ceramic ferrule stem 210 according to another aspect of the present invention. The ferrule stem 210 extends from a first end 201' to an opposed second end 202' along the length thereof, defining a longitudinal extension axis (central axis) of the ferrule stem 210. A substantially cylindrical central bore 203' having a substantially cylindrical inner diameter (ID) extends along the length of the ferrule stem 210 from a circular opening at the first end 201' to a circular opening at the second end 202' thereof. A first annular flange 211' is provided, circumscribing the outer diameter (OD) of the ferrule stem 210 and spaced a distance away from the second end 202', and a second annular flange 212' is provided, circumscribing the outer diameter OD of the ferrule stem 210 proximate and defining the second end 202' of the ferrule stem 210.

The outer diameter of the second flange 212' is greater than the outer diameter of the first flange 211', and the outer diameter of the first flange 211' is greater than the OD of the ferrule stem 210. Like with the embodiment described in connection with FIGS. 3A and 3B, preferably, the outer diameter of the first flange 211' of the ferrule stem 210 is 1.3 inches, the outer diameter of the second flange 212' is 1.5 inches and the OD of the ferrule stem 210 is 1.1 inches. It is also preferred that the first flange 211' is spaced a distance of 1.0 inch, more preferably 0.250 inches, from the second end 202' of the ferrule stem 210 in the longitudinal extension direction.

The annular flange 211' of the ferrule stem 201 has a slot 230 having a helically-shaped opening 231 (slot first part), rather than the axially parallel-oriented opening 221 (slot first part) shown in FIGS. 3A and 3B. In this case, the angled shape of the opening 231 twists helically around the axis of the ferrule stem 210 for even greater security and radial blocking, but still engages the tab T in a similar manner to accept and retain the tab T on the ferrule head 100 in the slot second part 232 after the ferrule stem 210 is rotated into place with respect to the ferrule head 100 to define the assembly 600, as described below in connection with FIG. 6B.

Preferably, the angle of the helically-shaped opening (slot first part 231) of the slot 230 extends at an angle in a range of 25-35°, more preferably not more than 45° with respect to the longitudinal extension axis (central axis) of the ferrule stem 210. In connection with the above, the dimensions of the slot first part 231 (i.e., width and length) must at least matingly correspond to the dimensions of the tab T, so that the T is able to pass through the angled slot first part 231 of the helically-shaped slot 230 and then reside within the adjacent slot second part 232, in a similar manner as that described above in connection with the slot 220 shown in FIGS. 3A and 3B, without becoming dislodged during operative use without otherwise purposefully providing the required counter rotation needed to disengage the mechanically interlocked ferrule pieces.

Figure 4A:
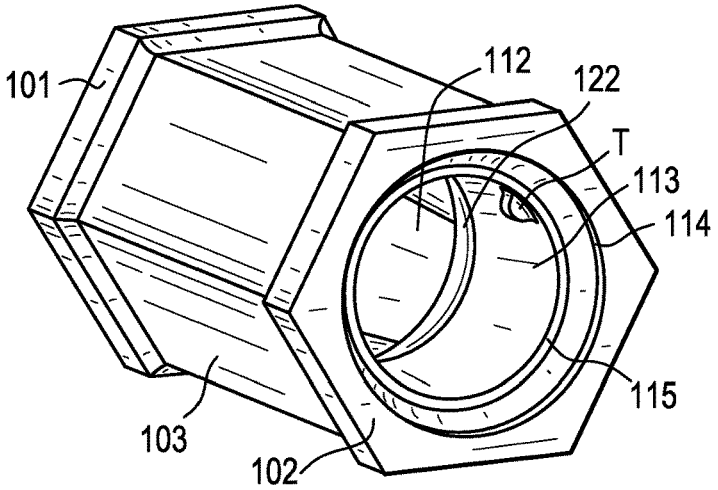
FIG. 4A is a perspective view of a ceramic ferrule head 100 according to the present invention.
Figure 4B:
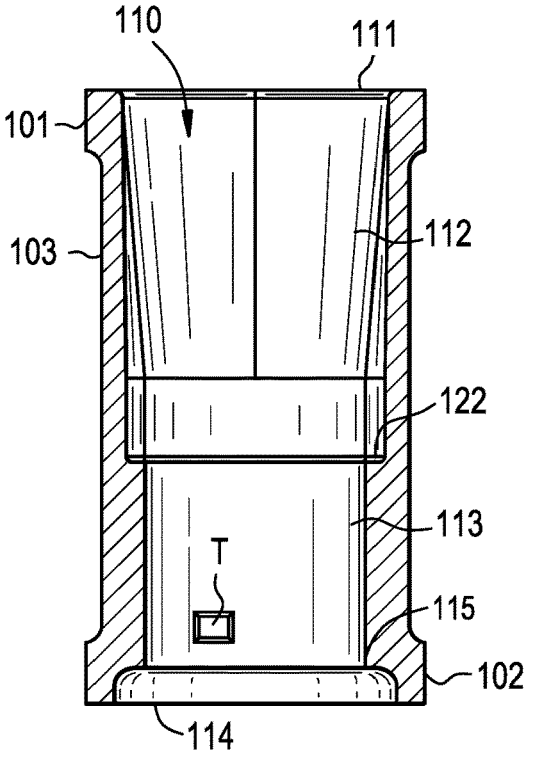
FIG. 4B is a cross-sectional (cut-view) of the ceramic ferrule head 100 shown in FIG. 4A.

FIG. 4A is a perspective view of a ceramic ferrule head 100 according to the present invention, and FIG. 4B is a cross-sectional (cut-view) of the ceramic ferrule head 100 shown in FIG. 4A. The ferrule head 100 has a substantially hexagonal outer peripheral surface 103 and extends from a first end 101 to an opposed second end 102 along the length thereof, defining a longitudinal extension axis (central axis) thereof. The ferrule head 100 has a central bore 110 that extends from a first hexagonal opening 111 in the first end 101 to a circular opening 114 in the second end 102. The central bore 110 has a first section 112 having a tapered hexagonal inner peripheral shape that extends from the first hexagonal opening 111 toward an annular ridge 122, which defines a transition point of the central bore 110. A second section 113 of the central bore 110 having a cylindrical inner peripheral shape extends from the annular ridge 122 toward the circular opening 114 at the second end 102 of the ferrule head 100.

The varied shape of the inner peripheral surface of the ferrule head 100 is provided for several reasons. One such reason is that having a hexagonal opening 111 at one end and a hexagonal inner peripheral surface 112 that transitions in a tapered manner toward the circular opening 114 decreases thermal stresses and provides an improvement in pressure loss as opposed to having a straight, open central bore construction along the length of the ferrule head 100. Another reason is that the inner annular ridge 122 provides not only a geometrical transition point between the tapered hexagonal section 112 and the cylindrical section 113 of the central bore 110, but also provides a seat surface for enabling at least some degree of axial retention of the ferrule stem 200 in the insertion direction (see, e.g., FIGS. 5A-5C and 6A). The annular ridge 122 also cooperates with the first annular flange 212 of the ferrule stem 200 to prevent process gas from penetrating therebehind.

At least one locking member, such as tab T, is provided on a portion of the inner peripheral surface of the second section 113 of the ferrule head 100, preferably proximate the second end 102 thereof. The preferred location for the tab(s) is in the lower section of the ferrule head 100 so as to engage the slot 220 on the first flange 211 of the ferrule stem 200, although if wall thickness restrictions dictate, it is possible to locate the tab(s) in the upper section of the ferrule head 100 to instead engage a similar slot that can likewise be provided in the second flange 212 of the ferrule stem 200.

As shown, the tab T extends from the cylindrical inner peripheral surface of the second section 113 of the central bore 110 of the ferrule head 100 inwardly, substantially perpendicular to the longitudinal extension axis of the ferrule head 100. The tab T on the inside of the ceramic ferrule head 100 may have any suitable shape that appropriately engages the appropriate slot in the stem 200, but is preferably round, trapezoidal, or square. In order to ensure adequate strength of the tab T, the aspect ratio of the minimum radial width (extending along the inside diameter of the ferrule head 100) to the height (outwardly projecting distance dimension) of the tab T should be at least 2:1.

Figure 5C:
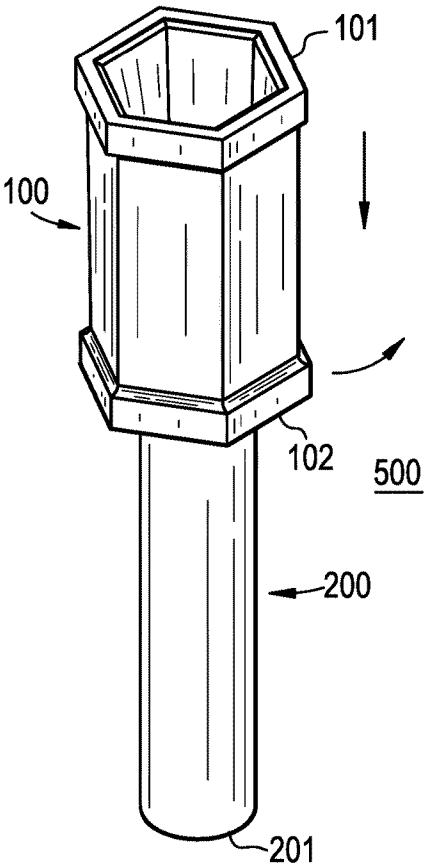
FIGS. 5A-5C are assembly views showing the steps for joining the ceramic ferrule head 100 and ceramic ferrule stem 200 together to form a ceramic ferrule assembly 500 according to the present invention.
Figure 5B:
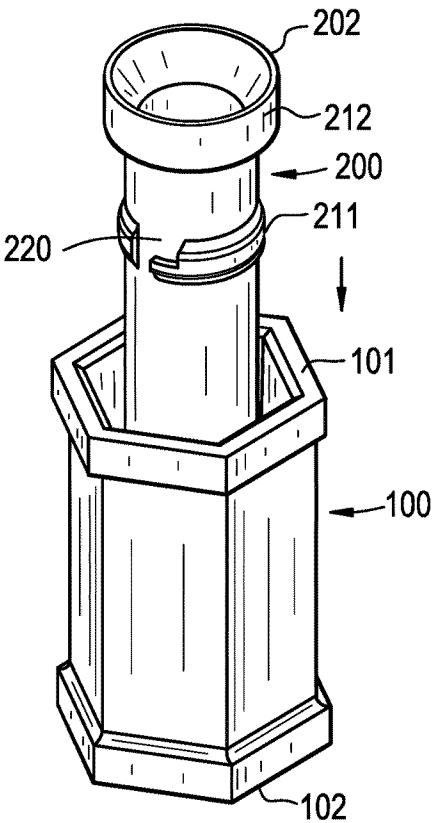
Figure 5A:
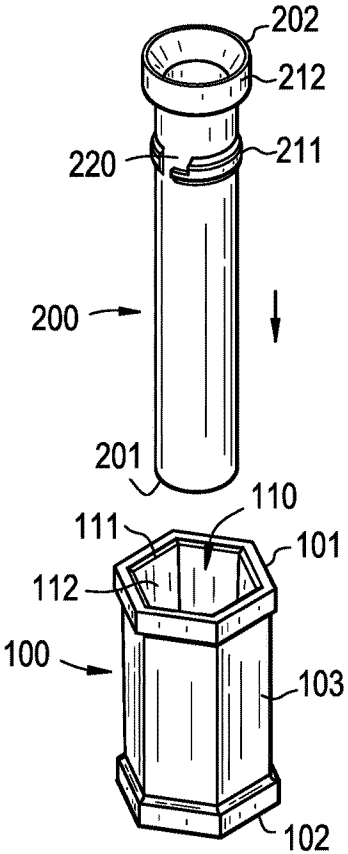

FIGS. 5A-5C are assembly views showing the steps for joining the ceramic ferrule head 100 and ferrule stem 200 to form the ceramic ferrule assembly 500 according to the present invention. As shown in FIG. 5A, the first end 201 of the ferrule head 200 is inserted into the hexagonal opening 111 of the central bore 110 of the ferrule head 100 in the direction indicated by the arrow, so that the longitudinal extension axis (central axis) of the ferrule stem 200 is aligned with the longitudinal extension axis of the ferrule head 100 (coaxial alignment). The ferrule stem is continually inserted downward (in the arrow direction shown), as shown in FIG. 5B, until the tab T of the ferrule head 100 passes through the first part 221 of the slot 220 of the ferrule stem 200.

The ferrule stem 100 is then rotated about its longitudinal extension axis (central axis), thereby directing the radially oriented tab T of the ferrule head 100 into the circumferential extension portion 222 of the slot 220 in the ferrule stem 200. Because of the interlocking mechanical relationship or interference between the tab T and the slot 220, the ferrule stem 200 cannot then be removed from the ferrule head 100 by a single force in the axial direction. That is, once tab T passes through the slot 220, the ferrule stem 200 is rotated into a position such that tab T cannot pass back through the slot 220 without purposefully performing a precise counter rotation.

The requirement for rotation, as well as axial extraction of the ferrule stem 200 to disassemble the ferrule assembly 500 significantly reduces the chances that the ferrule stem 200 might undesirably disassociate from the ferrule head 100 during operation. The ferrule stem 200 is preferably rotated about 0.25 inches or about 10°, depending on the precise dimensions of the slot 220 and tab T, so that the tab T resides in the correct position within the second portion 222 of the slot 220 (see, e.g., FIGS. 6A and 7).

As shown in FIG. 5C, in the ferrule assembly 500, the first end 201 of the ferrule stem 200 extends beyond the second end 102 of the ferrule head 100, and the second end 202 of the ferrule stem 200 is housed within the central bore 110 of the ferrule head 100.

Figure 6A:
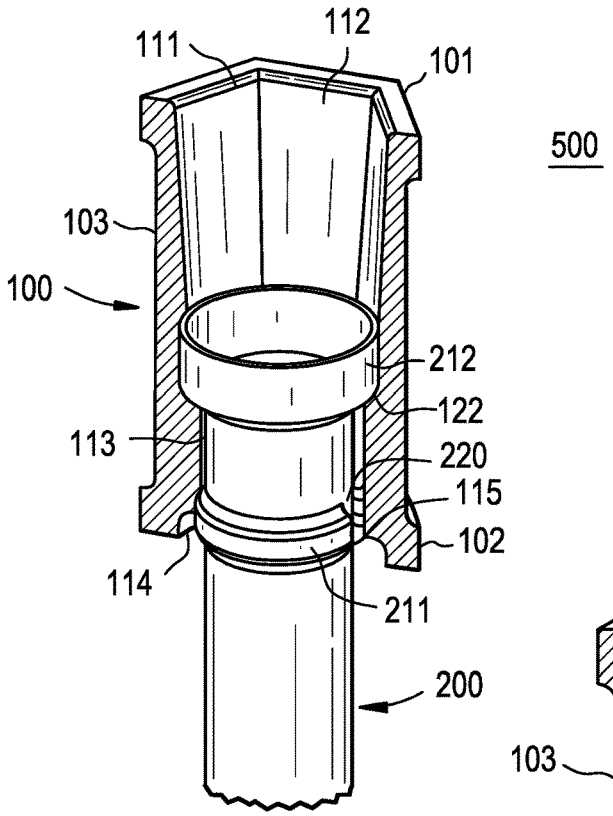
FIG. 6A is a cut-view showing the ferrule assembly 500 in FIG. 5C.
Figure 7:
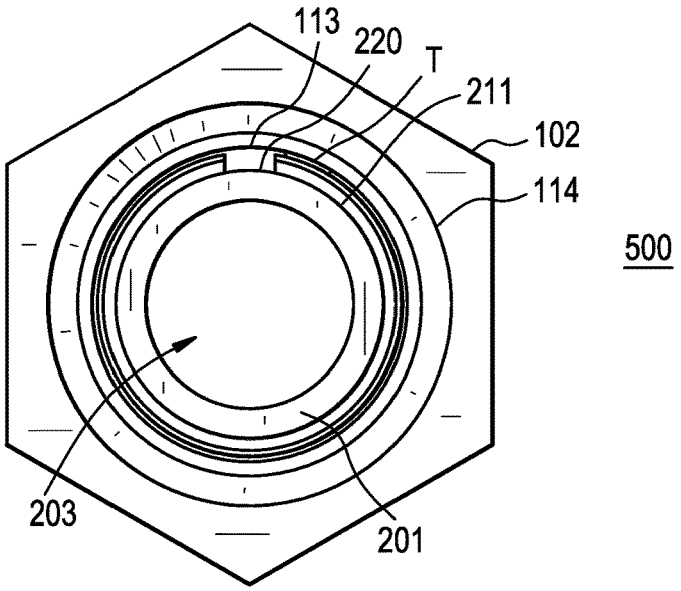
FIG. 7 is a bottom view of the ferrule assembly 500 shown in FIGS. 5C and 6A.

FIG. 6A is a cross-sectional (cut-view) showing the assembly 500 in FIG. 5C, and FIG. 7 is a bottom view of the assembly 500 shown in FIGS. 5C and 6A. The tab T cannot be seen in FIG. 6A given the rotated state of the ferrule head 200, because the annular flange 211 obscures the view of the tab T. This is clear based on the bottom-view shown in FIG. 7, where only a portion of the tab T extending from the cylindrical surface 113 can be seen behind the annular flange 211 in a location corresponding to the second portion 222 (not shown) of the slot 220. The bottom face of the first flange 212 of the ferrule stem 200 is seated on the annular ridge 122 within the central bore 110 of the ferrule head 100, as described above. This prevents further axial movement in the insertion direction indicated by the arrows shown in FIGS. 5A-5C, and provides the thermal and processing benefits described above.

Figure 6B:
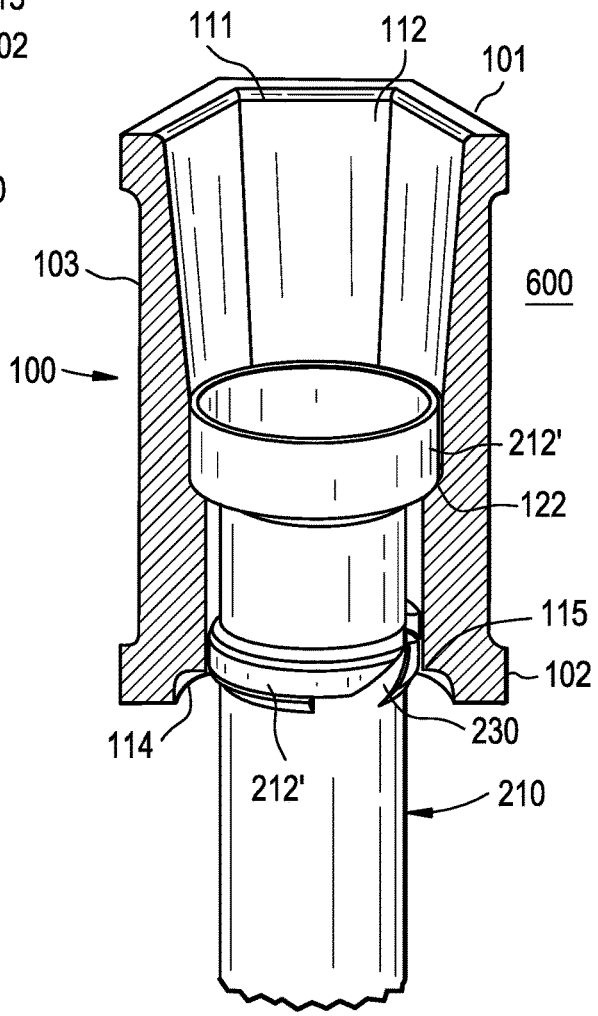
FIG. 6B is a cross-sectional (cut view) showing a ferrule assembly 600 according to another aspect of the present invention.

FIG. 6B is a cut view showing an assembly 600, where the first annular flange 211' of the ferrule stem 210 has a helically-shaped slot (see, e.g., FIGS. 3C and 3D). The tab T of the ferrule head 100 cannot be seen in FIG. 6B given the rotated state of the ferrule head 210, because the annular flange 211' obscures the view of the tab T. The bottom face of the first flange 212' of the ferrule stem 210 is seated on the annular ridge 122 within the central bore 110 of the ferrule head 100, as described above. This prevents further axial movement in the insertion direction indicated by the arrows shown in FIGS. 5A-5C.

Figure 8:
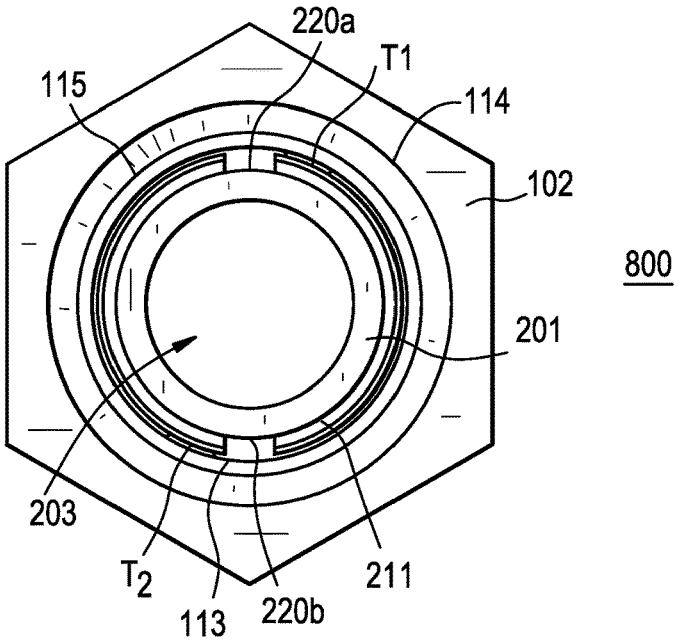
FIG. 8 is a bottom view of a ferrule assembly 800 according to another aspect of the present invention.

FIG. 8 is a bottom view of an assembly 800 according to another aspect of the present invention. In this embodiment, the ferrule head 100 includes are two tabs, $T_1$ and $T_2$, diametrically opposed to one another about the inner circumference of the cylindrical peripheral surface 113 of the central bore 110 of the ferrule head 100 (i.e., separated by 180°. Likewise, the radial flange 211 of the ferrule stem 200 includes two diametrically opposed slots 220*a* and 220*b*, which rotatably engage the respective Tabs $T_1$ and $T_2$ in the same manner described above when the ferrule stem 200 is inserted into the ferrule head 100 and rotated into the locked position.

Although no fiber wraps or gaskets are shown in the accompanying Figures, it should be readily understood that they may still included in the overall design, but were removed for simplicity of view and explanation. Such fiber wraps and gaskets are not needed in order to functionally secure the ferrule stem 200 and head 100 to one another, as in the prior art design, however.

While the present invention has been shown and described above with reference to specific examples, it should be understood by those skilled in the art that the present invention is in no way limited to these examples, and that variations and modifications can readily be made thereto without departing from the scope and spirit of the present invention.

What is claimed is:

1. A ceramic ferrule assembly comprising:

a ferrule head comprising at least one tab protruding outwardly from an inner peripheral surface thereof; and a ferrule stem extending from a first end toward an opposed second end in a longitudinal extension direction defining a length thereof, the ferrule stem comprising a first annular flange about an outer peripheral surface of the ferrule stem that is spaced a distance from the first and second ends of the ferrule stem in the longitudinal extension direction, and a second annular flange about the outer peripheral surface of the ferrule stem that is proximate and defines the second end of said ferrule stem and that is spaced a distance from the first annular flange in the longitudinal extension direction, wherein the first annular flange has at least one slot formed therein, said at least one slot is non-helical and comprises a first portion extending parallel to the longitudinal extension direction from a first end of said first flange to a second end of said first flange and a second portion extending perpendicular to the first portion, said at least one slot being adapted to receive said at least one tab and retain said at least one tab in a stationary position when said ferrule stem is rotated relative to said ferrule head;

whereby said at least one tab and said at least one slot secure said ferrule stem and said ferrule head to prevent axial and radial disassociation from one another without counter rotation.

2. The ceramic ferrule assembly according to claim 1, wherein an opening of said at least one slot is parallel with respect to the longitudinal extension direction of said ferrule stem.

3. The ceramic ferrule assembly according to claim 1, wherein said at least one tab comprises two tabs diametrically opposed to one another on said inner peripheral surface of said ferrule head.

4. The ceramic ferrule assembly according to claim 3, wherein said at least one slot comprises at least two slots diametrically opposed to one another on said annular flange.

5. The ceramic ferrule assembly according to claim 4, wherein said two slots are parallel with respect to the longitudinal extension direction of said ferrule stem.

6. The ceramic ferrule assembly according to claim 1, wherein said at least one tab is integrally formed with said ferrule head.

7. A ceramic ferrule assembly comprising:

a ferrule head having a hexagonal outer peripheral shape and extending from a first end to an opposed second end thereof defining a length thereof, said ferrule head having a central bore extending along said length thereof, and defining a longitudinal extension axis thereof, from a hexagonal opening at said first end of said ferrule head to a circular opening at said second end of said head, said central bore having an inner peripheral surface defined by a first section having a tapered hexagonal shape extending from said first hexagonal opening to an annular ridge, and a second section having a cylindrical shape extending from said annular ridge to said circular opening, and said ferrule head having at least one tab extending from a portion of said inner peripheral of said central bore of ferrule head; and a ferrule stem extending from a first end toward an opposed second end in a longitudinal extension direction defining a length thereof, and having a first annular flange spaced a distance away from both said first and second ends of said ferrule stem along the longitudinal extension direction of said ferrule stem and having at least one slot formed therein, said at least one slot is non-helical and comprises a first portion extending parallel to the longitudinal extension direction from a first end of said first flange to a second end of said first flange and a second portion extending perpendicular to the first portion, and a second annular flange located proximate and defining said second end of said ferrule stem and spaced a distance from the first flange in the longitudinal extension direction of the ferrule stem;

wherein said at least one tab of said ferrule head resides in the second portion of said at least one slot in a rotatably engaged position, mechanically securing said ferrule stem to said ferrule head to prevent axial and radial disassociation without counter rotation; and wherein said second flange of said ferrule stem is seated on said annular ridge of said inner peripheral surface of said ferrule head.

8. The ceramic ferrule assembly according to claim 7, wherein an outer diameter of said second flange of said ferrule stem is greater than an outer diameter of said first flange of said ferrule stem, and said outer diameter of said first flange is greater than an outer diameter of said ferrule stem.

9. The ceramic ferrule assembly according to claim 7, wherein an opening of said at least one slot is parallel with respect to the longitudinal extension direction of said ferrule stem.

10. The ceramic ferrule assembly according to claim 7, wherein said at least one tab comprises two tabs diametrically opposed to one another on said inner peripheral surface of said ferrule head.

11. The ceramic ferrule assembly according to claim 10, wherein said at least one slot comprises at least two slots diametrically opposed to one another on said first annular flange.

12. The ceramic ferrule assembly according to claim 11, wherein openings of said two slots are parallel with respect to said longitudinal extension direction of said ferrule stem.

13. The ceramic ferrule assembly according to claim 7, wherein said at least one tab is integrally formed with said ferrule head.

14. The ceramic ferrule assembly according to claim 7, wherein said at least one tab is formed on a portion of said second section of said inner peripheral surface of said central bore of said ferrule head proximate said second end of said ferrule head.

* * * * *